US005267679A

United States Patent [19]

Kamaya et al.

[11] Patent Number: 5,267,679

[45] **Date of Patent: * Dec. 7, 1993**

[54] CASE FOR CARRYING A VIDEO CAMERA AND ACCESSORIES

[75] Inventors: Naoki Kamaya; Koichi Nishimura, both of Tokyo, Japan

[73] Assignee: Sony Corporation, Tokyo, Japan

[ * ] Notice: The portion of the term of this patent subsequent to Jun. 15, 2010 has been disclaimed.

[21] Appl. No.: 899,228

[22] Filed: Jun. 16, 1992

Related U.S. Application Data

[63] Continuation of Ser. No. 591,438, Oct. 1, 1990, abandoned.

[30] Foreign Application Priority Data

Oct. 7, 1989 [JP] Japan ..... 1-262762

[51] Int. Cl.[5] ..... A45C 3/00

[52] U.S. Cl. ..... 224/151; 224/208; 224/224; 224/253; 224/272; 224/908; 206/316.2; 190/102; 190/127; 190/108; 383/119; 024/585

[58] Field of Search ..... 224/151, 153, 191, 202, 224/205, 206, 208, 209, 213, 215, 216, 224–226, 240, 253, 257, 262, 272, 908; 206/316.1, 316.2; 24/68 E, 68 R, 585; 383/4, 37, 119; 190/102, 127, 108–111, 122–124; 150/130; 220/408, 410, 411, 413; 141/390

[56] References Cited

U.S. PATENT DOCUMENTS

| | | | |
|---|---|---|---|
| 1,504,292 | 8/1924 | Wickes | 220/410 |
| 1,521,310 | 12/1924 | Moran | 190/108 |
| 2,461,526 | 2/1949 | Cull et al. | 224/209 |
| 2,889,095 | 6/1959 | Heidecke et al. | 224/257 |
| 3,207,419 | 9/1965 | Mack | 383/119 |
| 3,225,983 | 12/1965 | Majka | 224/151 X |
| 3,363,814 | 1/1968 | Hall, Jr. et al. | 224/908 X |
| 4,059,207 | 11/1977 | Jackson et al. | 224/153 X |
| 4,093,010 | 6/1978 | Hunley et al. | 206/316.2 |
| 4,260,004 | 4/1981 | Domke | 206/316.2 X |
| 4,424,841 | 1/1984 | Smith | 190/102 X |
| 4,431,041 | 2/1984 | Leiserson | 206/316.2 |
| 4,442,960 | 4/1984 | Vetter | 190/108 X |
| 4,463,789 | 8/1984 | Leiserson | 206/316.1 X |
| 4,491,258 | 1/1985 | Jones | 224/153 |
| 4,506,769 | 3/1985 | Franco et al. | 190/108 |
| 4,515,300 | 5/1985 | Cohen | 224/151 |
| 4,545,414 | 10/1985 | Baum | 224/908 X |
| 4,598,802 | 7/1986 | Abenaim | 190/127 X |
| 4,610,286 | 9/1986 | Cyr | 206/316.2 |
| 4,620,579 | 11/1986 | Lowe | 206/316.2 |
| 4,629,040 | 12/1986 | Jones | 190/102 |
| 4,727,630 | 3/1988 | Alan | 24/585 |
| 4,733,806 | 3/1988 | Shoop | 206/316.2 |
| 4,762,211 | 8/1988 | Krenzel | 190/127 X |
| 4,810,102 | 3/1989 | Norton | 383/4 |
| 4,842,032 | 6/1989 | Mastronardo | 206/316.2 X |
| 4,884,731 | 12/1989 | Sibley | 224/215 |
| 4,900,163 | 2/1990 | Mack | 383/119 |
| 4,923,060 | 5/1990 | Breslau | 224/908 X |
| 5,086,888 | 2/1992 | Chu | 190/127 X |

FOREIGN PATENT DOCUMENTS

| | | | |
|---|---|---|---|
| 3634621 | 4/1988 | Fed. Rep. of Germany | 224/213 |
| 2112816 | 6/1972 | France | 190/127 |
| 678305 | 9/1952 | United Kingdom . | |
| 1354857 | 5/1974 | United Kingdom . | |
| 2029692A | 3/1980 | United Kingdom . | |

*Primary Examiner*—Henry J. Recla
*Assistant Examiner*—Casey Jacyna
*Attorney, Agent, or Firm*—Philip M. Shaw, Jr.

[57] ABSTRACT

A video camera carrying case has an accessory accommodating portion with a reinforcing member detachably fastened to a video camera accommodating portion by a fastening member. The tightness with which the accessory accommodating portion is fastened to the video camera accommodating portion is changed by the fastening member, thereby improving the portability of the video camera carrying case.

6 Claims, 5 Drawing Sheets

CASE FOR CARRYING A VIDEO CAMERA AND ACCESSORIES

This is a continuation of co-pending U.S. patent application Ser. No. 07/591,438 filed on Oct. 1, 1990, now abandoned.

BACKGROUND OF THE INVENTION

1. Field of the Invention

The present invention relates generally to carrying bags and more particularly to a video camera carrying bag for accommodating therein a video camera and related video camera accessories.

2. Description of the Prior Art

Various kinds of video camera carrying bags or cases have been proposed for accommodating a video camera and its related accessories. Japanese Patent Laid-Open Gazette No. 64-37353 of the same assignee of the instant application describes a substantially trunk-shaped video camera carrying case in which a video camera and accessories are accommodated side by side. Japanese Utility Model Laid-Open Gazette No. 61-190223 describes such a carrying bag for only the video camera.

Typically, a video camera utilizes a secondary battery as a power source for taking pictures. Thus, a battery charger (including an AC power adaptor) for charging the secondary battery is one of the most important video camera accessories, and is practically indispensable for long trips. If the carrying bag holds only the video camera, then the AC power adaptor must be carried independently. If the video camera and accessories are carried together, the carrying bag may become unavoidably large in size, which makes the carrying bag difficult to carry.

On the other hand, if the video camera is only to be used for a relatively short period of time, the AC power adaptor is not needed, but instead the auxiliary secondary battery must be carried. In that case, if only a large bag is available and it is desired to leave the AC power adaptor behind, then the large bag must be carried. This may be very cumbersome.

OBJECTS AND SUMMARY OF THE INVENTION

Accordingly, it is an object of the present invention to provide an improved video camera carrying bag which can eliminate the aforementioned shortcomings and disadvantages encountered with the prior art.

More specifically, it is an object of the present invention to provide a video camera carrying bag in which a video camera can be carried alone or in which the video camera and its related accessories can be carried together.

According to the present invention, a carrying bag is comprised of a first bag for accommodating a video camera or the like, a second bag for accommodating video camera accessories and the like, and a fastening belt which allows the tightness of fastening to be changed, wherein the first and second bags are detachably fastened together by the fastening belt.

The preceding and other objects, features and advantages of the present invention will be apparent in the following detailed description of a preferred embodiment, which is to be taken in conjunction with the accompanying drawings in which like reference numerals are used to identify the same or similar parts in the several views.

DETAILED DESCRIPTION OF THE PREFERRED EMBODIMENT

FIGS. I through 5 of the drawings depict various preferred embodiments of the present invention for purposes of illustration only. One skilled in the art will readily recognize from the following discussion that alternative embodiments of the structures and methods illustrated herein may be employed without departing from the principles of the invention described herein.

Figure 1B:
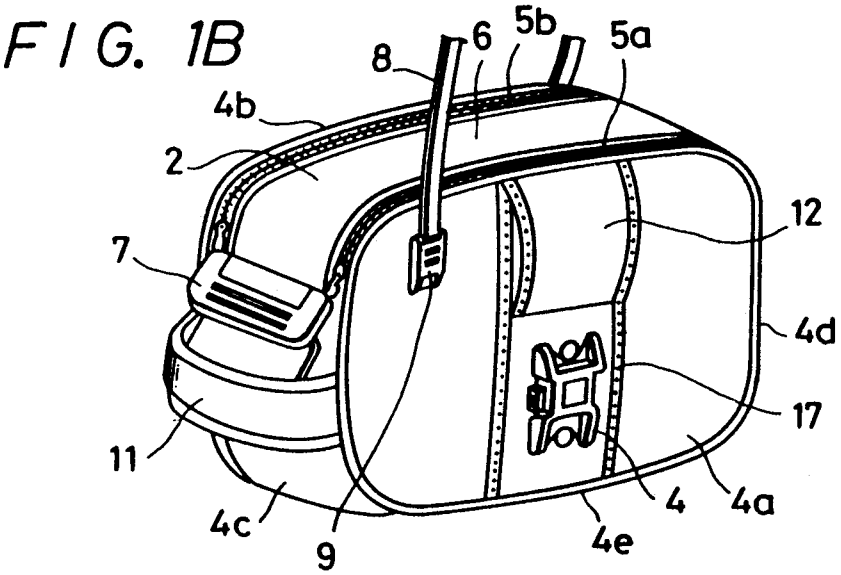
FIGS. 1A to 1E are perspective views of varying methods of use of one embodiment of a video camera carrying bag according to the present invention.
Figure 1C:
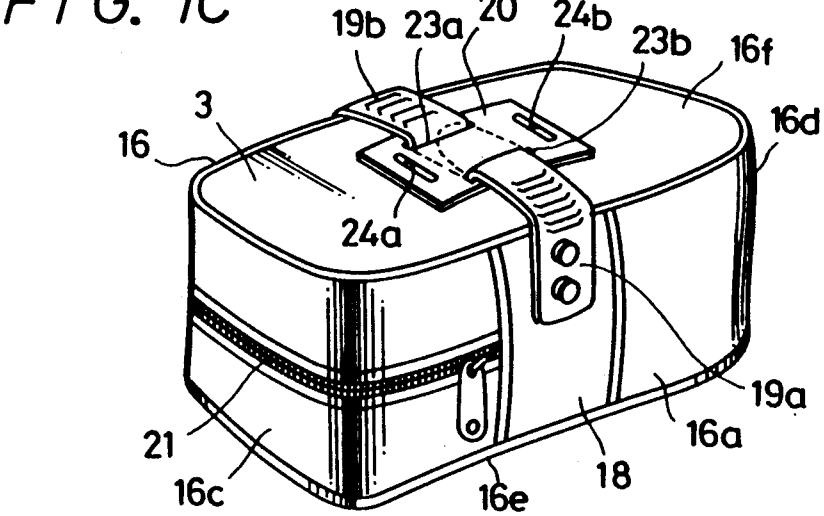
Figure 1A:
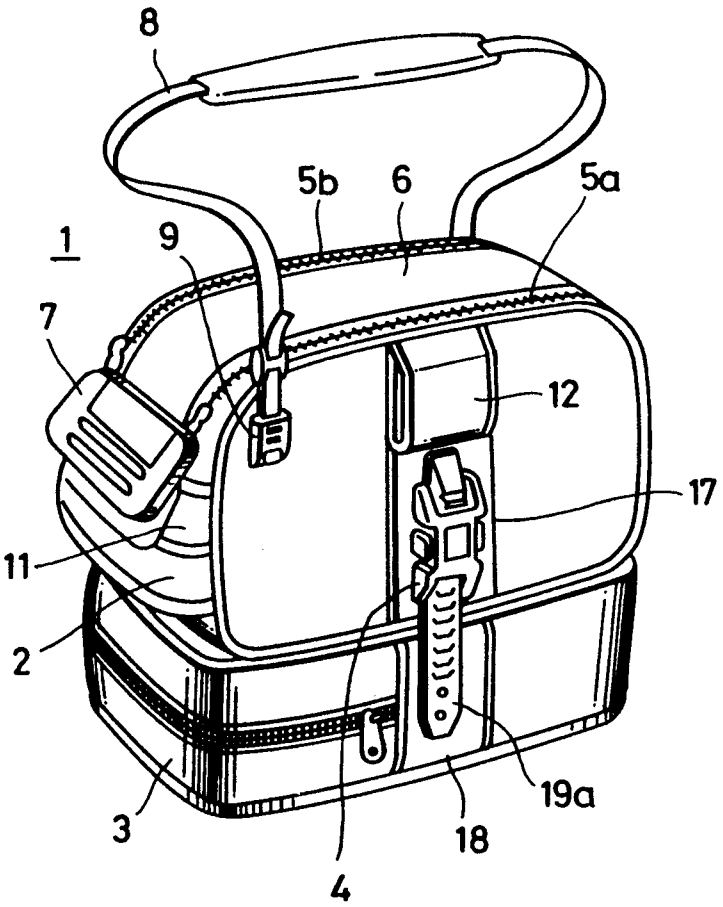

FIG. 1A shows an overall arrangement of an embodiment of the video camera carrying bag according to the present invention. A video camera carrying bag 1 is comprised of a camera bag 2 and an accessory bag 3, and the camera bag 2 and the accessory bag 3 are detachably fastened together by a fastening belt.

Figure 2A:
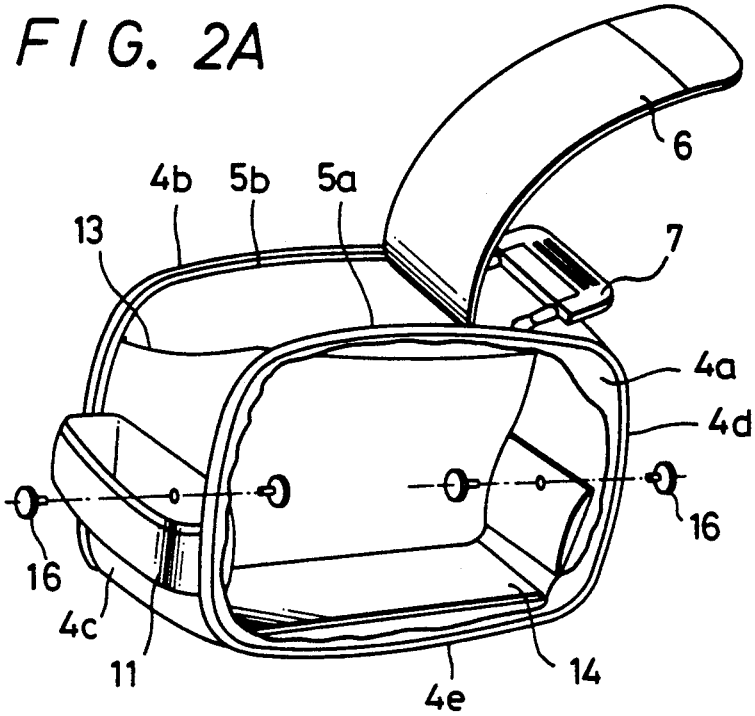
FIGS. 2A and 2B are cutaway views illustrating the camera bag portion of the carrying bag of FIG. 1.

As shown in FIG. 1B, the camera bag 2 is comprised of front, rear, left, right and bottom bag members 4*a*, 4*b*, 4*c*, 4*d* and 4*e* which define a substantially rectangular shape and which are made of cloth, leather etc. Zippers 5*a* and 5*b* are respectively attached to the upper edges of the front and rear bag members 4*a* and 4*b*, and a belt-shaped upper lid 6 is provided between the zippers 5*a* and 5*b*. A zipper handle 7 made of, for example, a plastic material is stretched between the ends of zippers 5*a* and 5*b*. The belt-shaped upper lid 6 can be opened by moving the zipper handle 7 in the left to right direction as shown in FIG. 2A, and closed by moving the zipper handle 7 in the right to left direction.

Figure 3:
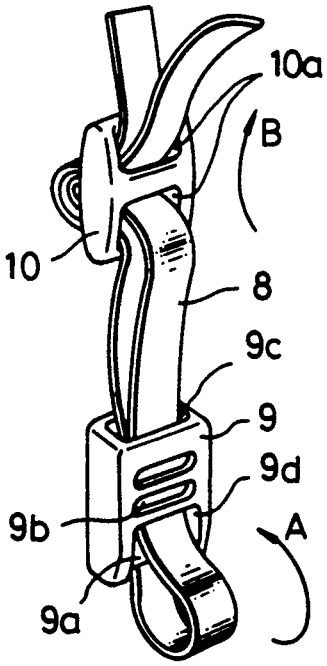
FIG. 3 is a perspective view of an end portion of a shoulder belt of the carrying bag of FIG. 1.

A shoulder belt 8 is attached to the upper left and right portions of the front and rear bag members 4*a* and 4*b*. Each of the end portions of the shoulder belt 8 is engaged with a belt inserting member 9 secured to the front and rear bag members 4*a* and 4*b*. The belt inserting member 9 may be made of a plastic material, and as shown in FIG. 3 is in the shape of a buckle comprised of a belt engaging portion 9*a* having a belt insertion slot 9*c*, an opening portion 9*d*, and a slit 9*b*. The slit 9*b* is used to remove slackening of the shoulder belt 8.

As shown in FIG. 3, there is provided a generally rectangular belt engaging member 10 which may also be made of a plastic material, and which contains two slot portions 10*a* that create a substantially B-letter shape. In use, one end of the shoulder belt 8 is inserted into the slots 10*a*, then into the belt inserting slot 9*c* of the belt inserting member 9 and turned around the belt engaging portion 9*a* as shown by an arrow A in FIG. 3. The end of the shoulder belt 8 is inserted again into the belt inserting slot 9*c* from the opening portion 9*d*. Thereafter, the end of the shoulder belt 8 is inserted into the slots 10*a* of the belt engaging member 10 as shown by an arrow B in FIG. 3 such that the shoulder belt 8 is engaged to the video camera bag 2.

As shown in FIG. I, a handle 11 made of cloth, leather or the like is attached to the left bag member 4c of the video camera bag 2 so as to bridge the edges of the front and rear bag members 4a and 4b. This handle 11 may be grasped to hold the bag 2 steady when the belt-shaped upper lid 6 is opened by moving the zipper handle 7 as shown in FIG. 2A. Also, this handle 11 may be used to carry the video camera bag 2 by hand without using the shoulder belt 8.

Sewed on to the front and rear bag members 4a and 4b of the video camera bag 2 at their middle positions are belt-shaped members 17. Each belt-shaped member 17 has at an upper portion thereof a belt loop 12 and at a lower portion thereof a fastening member 4. Fastening member 4 is used to tightly fasten the accessory bag 3 to the camera bag 2 in cooperation with a belt attached to the accessory bag 3, as will be described later.

The inside of the video camera bag 2 may be covered with a sewn-in lining, if desired, and an inside pocket 13 provided in the inside of the rear bag member 4b as shown in FIG. 2A. Also as shown in FIG. 2A, a bottom board 14, which is shaped substantially in a U-shape and may be made of a plastic material such as Nylon ® or the like, is inserted in the bottom of the bag 2. The bottom board 14 is secured to the insides of the left and right bag members 4c and 4d by metal fittings 16 which are secured in the inside of the bottom bag member 4e.

Figure 2B:
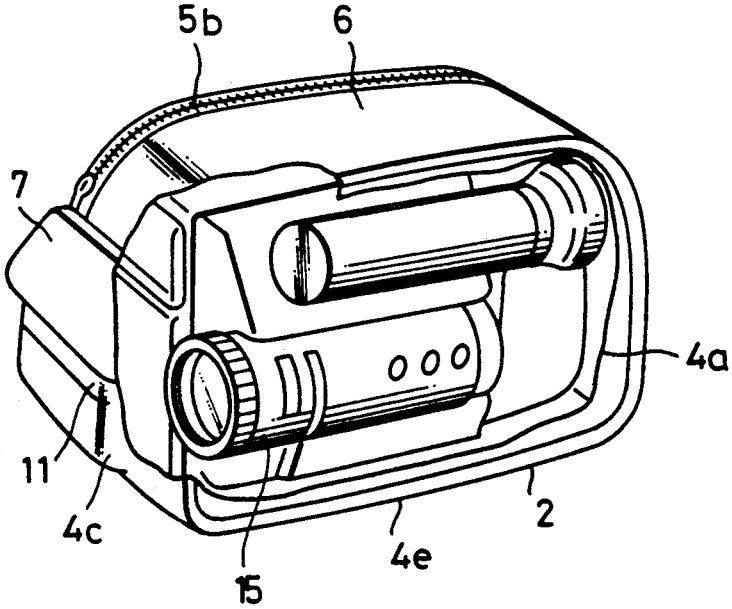

A video camera 15 is accommodated within the video camera bag 2 as shown in FIG. 2B. Although the bottom portion 4e of the video camera bag 2 is made of cloth, since the video camera bag 2 is provided with the Nylon ® bottom board 14, the video camera bag 2 can be prevented from being deformed at the bottom portion thereof. The inside of the bottom board 14 may be made furry to further prevent deformation of the bottom portion of the bag when it is loaded.

Referring back to FIGS. 1A to 1E, the accessory bag 3 will be described. As shown in FIG. 1C, the accessory bag 3 is comprised of front, rear, left, right, upper and lower bag members 16a, 16b, 16c, 16d, 16e and 16f which are each substantially rectangular and made of cloth, leather, etc. Sewed on the front and rear bag members 16a and 16b at substantially middle portions are belt-shaped members 18. Belts 19a and 19b which are, for example, molded are attached to the upper portions of the belt-shaped members 18. When the video camera bag 2 is not attached to the accessory bag 3, the tip ends of the belts 19a and 19b may be inserted into a belt loop 20 which is also made of, for example, plastic material. The belt loop 20 is attached to substantially the center of the upper bag member 16f. A zipper 21 is provided at substantially the central positions of the front, rear and left bag members 16a, 16b and 16c such that it may extend from one edge to the other edge of the belt-shaped members 18. By use of this zipper 21, the left half portion of the accessory bag 3 can be opened and/or closed as shown in FIG. 4B.

Figure 4C:
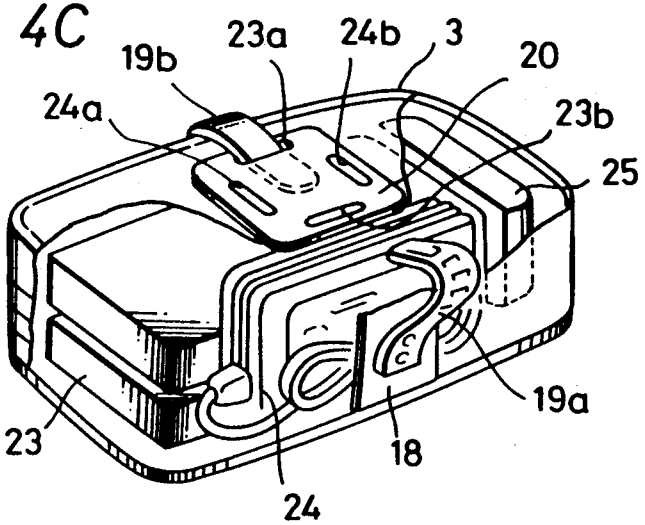
FIGS. 4A to 4C are perspective and cutaway views illustrating the accessory bag portion of the carrying bag of FIG. 1.
Figure 4A:
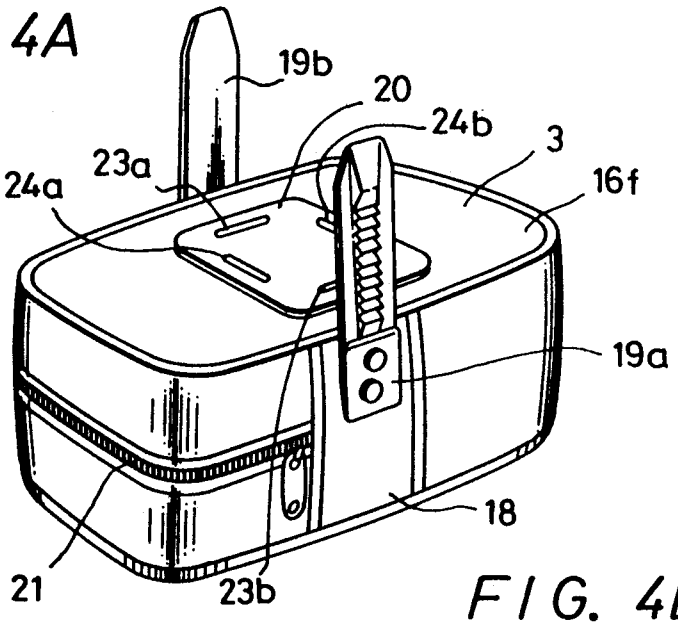
Figure 4B:
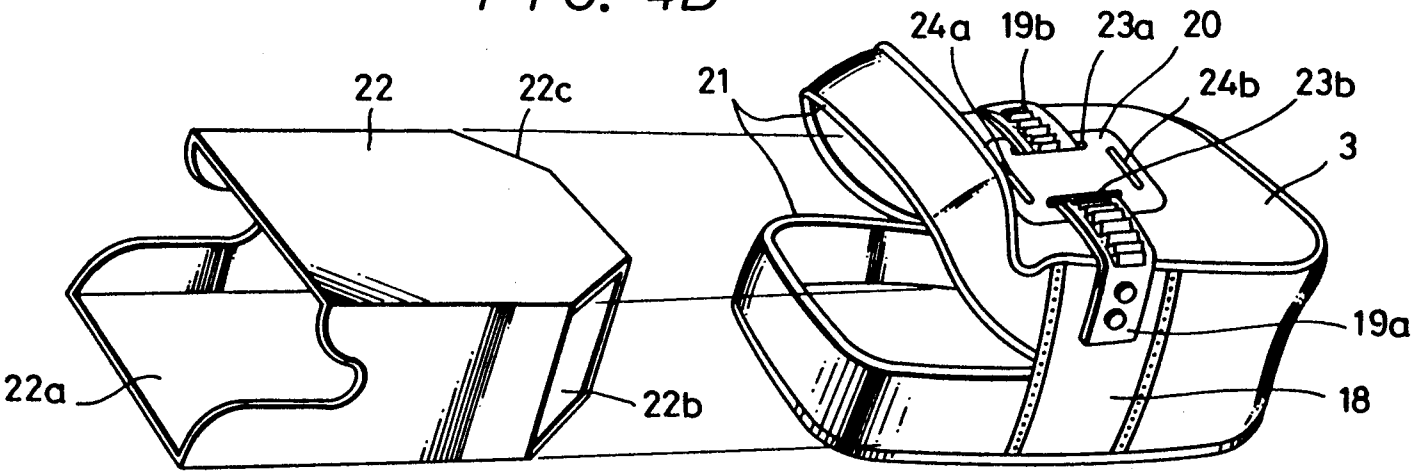

A reinforcing member 22 shown in FIG. 4B is inserted into the accessory bag 3 so that, even when the video camera bag 2 is put on the accessory bag 3, the accessory bag 3 is not damaged or deformed. The shape of the reinforcing member 22 may be determined by the desired size and shape of the accessory bag 3. In the example of FIG. 4B, the reinforcing member 22 is made of plastic material such as a Nylon ® foam board and is substantially a box in shape. An opening portion 22a is formed at the side surface of the reinforcing member 22 so that various accessories of video camera may be inserted into the reinforcing member 22 with ease. The right side corners of the reinforcing member 22 are cut away to provide cutaway portions 22b and 22c so that the reinforcing member 22 may be inserted into the accessory bag 3 with ease. As with bottom board 14, the outer surfaces of reinforcing member 22 may be made furry if desired. Also, the inside of accessory bag 3 may be lined as the camera bag 2, if desired.

In FIG. 4C, the accessory bag 3 is shown containing video cassette tapes 23, an AC power adaptor (charger) 24, a battery 25 and the like. As above, the belt loop 20 has slots 23a and 23b for receiving the ends of belts 19a and 19b. Slots 24a and 24b are also formed in the belt loop 20, in the direction perpendicular to slots 23a and 23b. A belt may be inserted through the slots 24a and 24b so that accessory bag 3 may be carried on the waist.

Figure 1D:
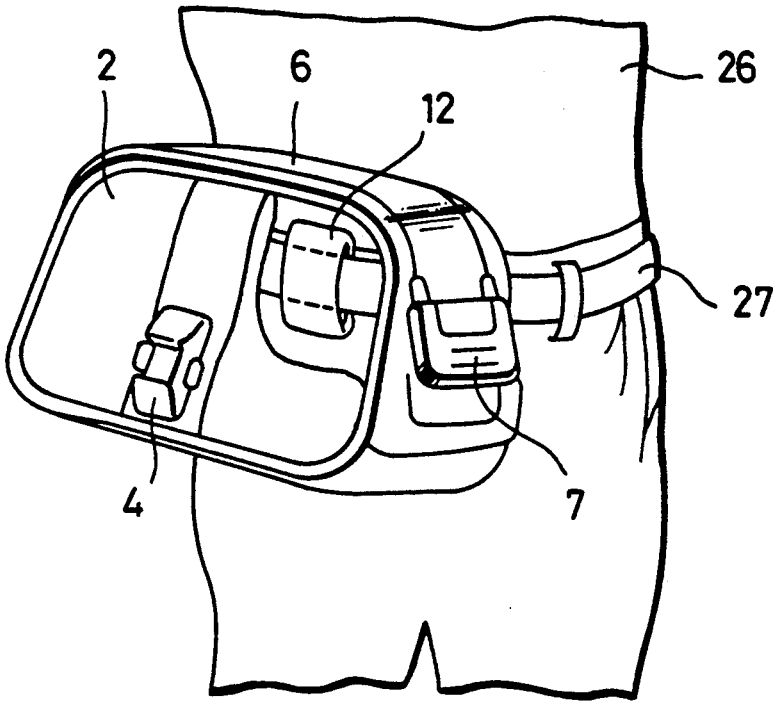
Figure 1E:
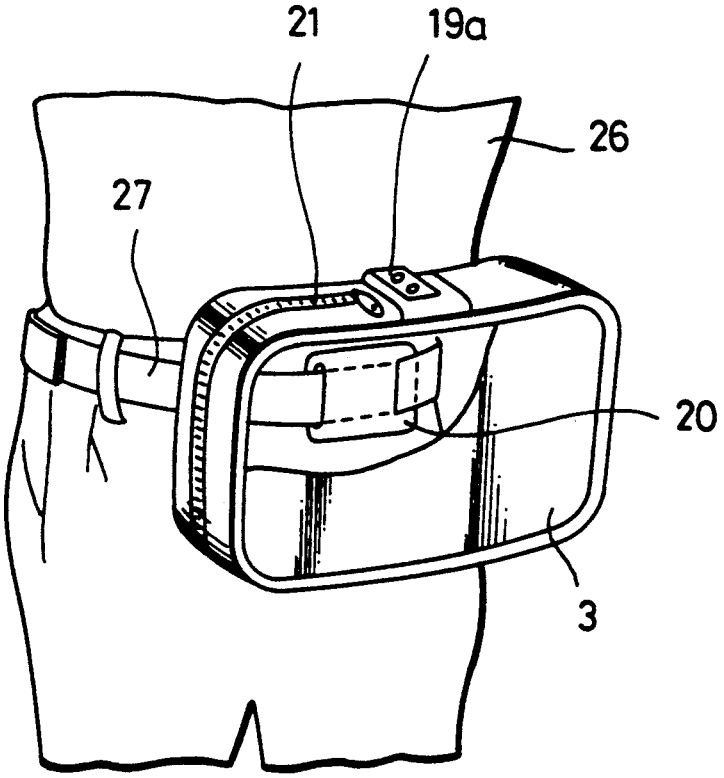

Thus, as shown in FIGS. 1D and 1E, either or both of the two detachable components, video camera bag 2 and accessory bag 3, can be carried fastened on a belt 27 worn by the user 26. This allows the user to operate the video camera 15 with both hands, thus increasing the convenience of operation.

When the video camera bag 2 and the accessory bag 3 are fastened together, as shown in FIG. 1A, the free ends of the belts 19a and 19b attached to the accessory bag 3 are released from the slots 23a and 23b of the belt loop 20, lifted in the vertical direction and inserted into and engaged with the fastening member 4 (see FIG. 1).

A method for coupling the fastening member 4 and the belts 19a and 19b will be described in detail with reference to FIGS. 5A to 5D.

Figure 5A:
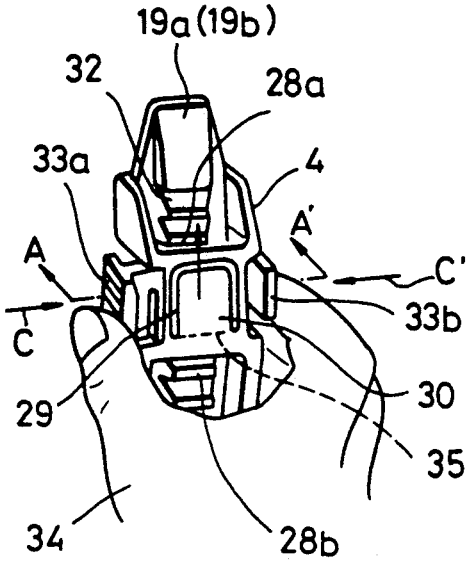
FIGS. 5A to 5D are varying views of a fastening member used in the carrying bag of FIG. 1.

The fastening member 4 may again be made by, for example, a plastic molding process, and is shaped substantially as a rectangular buckle which is provided at its upper and lower positions with belt insertion opening portions 28a and 28b as shown in FIG. 5A. A recess 29 of a U-shape is formed on the front surface of the buckle body of the fastening member 4 as shown in FIG. 5A. The portion encircled by the recess 29 is provided as an engaging portion 30, and an engaging member 31 is formed on the top portion of the engaging portion 30 as shown in FIG. 5B, which is taken along the line A—A' in FIG. 5A. The engaging member 31 is engaged with a ratchet member 32 in the shape of a sawtooth formed on each of the belts 19a and 19b. When portions 33a and 33b which are formed with the buckle portion are pushed in the directions shown by arrows C and C' in FIG. 5A, the engaging portion 30 is displaced around a broken-line portion 35 shown in FIG. 5B in the clockwise direction of an arrow X. An example of this arrangement will be described with reference to FIGS. 5C and 5D.

Figure 5C:
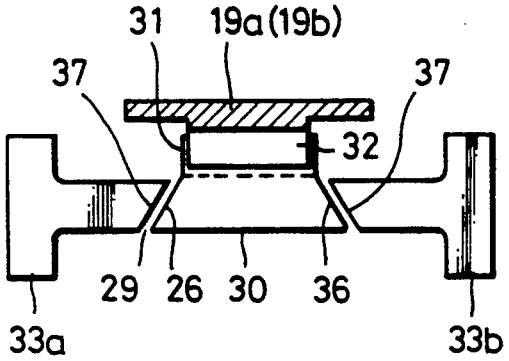
Figure 5B:
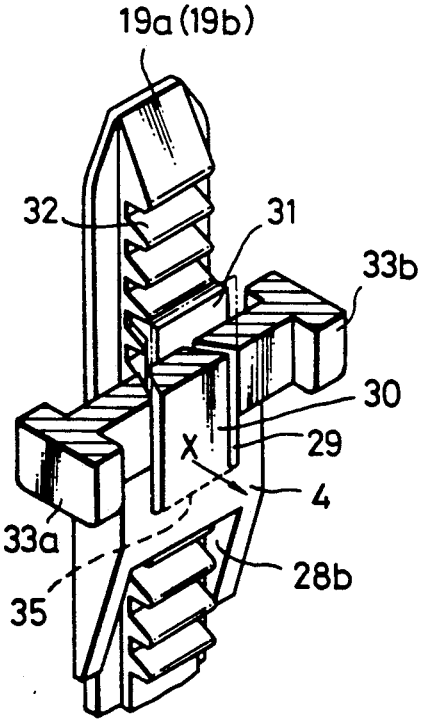

As shown in FIG. 5C, the recess 29 around the engaging portion 30 is tapered to provide tapered surfaces 36, and the pushing portions 33a and 33b are also tapered at their surfaces opposing the recess 29 to provide tapered surfaces 37. FIG. 5C illustrates the condition that the ratchet member 32 of each of the belts 19a and 19b is engaged with the engaging member 31 formed on the tip end portion of the engaging portion 30. If the pushing portions 33a and 33b are pushed as shown by arrows D and D' in FIG. 5D from this condition, the tapered surfaces 36 of the engaging portion 30 pushed by the tapered surfaces 37 of the pushing portions 33a and 33b are displaced around the broken-line portion 35 (see FIG. 5B) in the direction shown by an arrow X in FIG. 5D, so that the engaging member 31 is released from the ratchet member 32 of the belts 19a and 19b.

In this state, the belts 19*a* and 19*b* can be inserted into the insertion opening portions 28*a* and 28*b* of the buckle portion of the fastening member 4 so that, when the pushing portions 33*a* and 33*b* are released at the predetermined positions, the state of FIG. 5C is presented and thus the fastening member 4 is placed in the engaged state. Accordingly, when the belts 19*a* and 19*b* of the accessory bag 3 are lifted up as shown in FIG. 4A, and video camera bag 2 is placed on the upper bag member 16*f*, the belts 19*a* and 19*b* are inserted into the insertion opening portions 28*a* and 28*b* of the fastening member 4 by pushing the pushing portions 33*a* and 33*b* of the fastening member 4, and the tightness of fastening is adjusted by lifting the belt 19*a* to the predetermined position and releasing the pushing portions 33*a* and 33*b* at the desired point. Thus, the video camera bag 2 and the accessory bag 3 can be tightly fastened together.

Figure 5D:
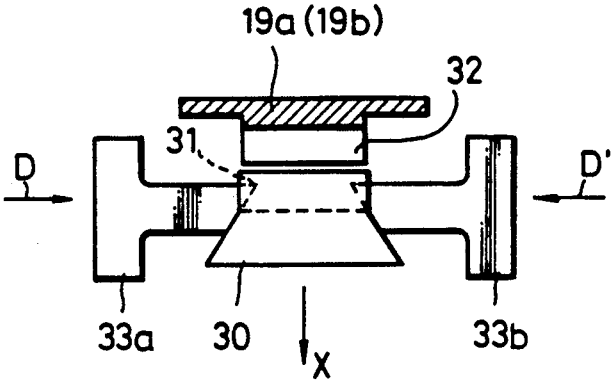

When it is desired to detach the video camera bag 2 from the accessory bag 3 from each other, the engaged state is released by pushing the pushing portions 33*a* and 33*b* to the pushed condition, presenting the state of FIG. 5D. Under this condition, the video camera bag 2 and the accessory bag 3 can be detached with ease.

Thus, the user has several options. The camera bag 2 and the accessory bag 3 may be attached and carried together. If the user wants to carry only the video camera bag 2, this can be done with the shoulder belt 8 or the handle 11 as shown in FIG. IB, or by carrying the bag on the waist with the belt 27 inserted into the belt loop 12 as shown in FIG. 1D. The user can carry the accessory bag 3 attached through its belt loop 20 to the belt 27 as shown in FIG. 1E. Finally, the user can carry both the camera bag 2 and the accessory bag 3 on the belt 27 at the same time.

Finally, since the accessory bag is unitarily formed, it may be arranged so as to be capable of being folded so that when the user does not want to carry the video camera accessories it may be folded and carried in the camera bag, so that the carrying bag remains relatively compact in size.

From the above description, it will be apparent that the invention disclosed herein provides a novel and advantageous video camera carrying case. The foregoing discussion discloses and describes merely exemplary methods and embodiments of the present invention. As will be understood by those familiar with the art, the invention may be embodied in other specific forms without departing from the spirit or essential characteristics thereof. For example, different materials than those described may be used. Specific features may also be changed, for example, the precise arrangement of the belt-shaped members, the belt loops, and the belt inserting members may all be changed. Also, the fastening member may be an ordinary belt or buckle type.

Accordingly, the disclosure of the present invention is intended to be illustrative, but not limiting, of the scope of the invention, which is set forth in the following claims.

We claim as our invention:

1. A video camera carrying bag comprising:

(a) a first bag for containing therein a video camera;

(b) a second bag for containing therein video camera accessories;

(c) ratchet fastening means for detachably fastening the first and second bags together, wherein the tightness of fastening is adjustable, wherein the ratchet fastening means includes a pair of grooved fastening belts, each having first and second ends, means for fastening the first ends of each of the fastening belts to the opposite sides of the second bag, and a pair of ratchet mechanisms, each ratchet mechanism being attached to a different side of the first bag for receiving and locking the second end of a different one of the fastening belts;

(d) a belt loop on top of the second bag for either stowing the second ends of the fastening belts when the first and second bags are not attached to each other or attaching the second bag to a belt of the user.

2. A video camera carrying bag comprising:

(a) a first bag for containing therein a video camera;

(b) a second bag for containing therein video camera accessories; and (c) ratchet fastening means for detachably fastening the first and second bags together, wherein the tightness of fastening is adjustable, wherein the ratchet fastening means includes a pair of grooved fastening belts, each having first and second ends, means for fastening the first ends of each of the fastening belts to the opposite sides of the second bag, and a pair of ratchet mechanisms, each ratchet mechanism being attached to a different side of the first bag for receiving and locking the second end of a different one of the fastening belts.

3. The video camera carrying bag of claim 2, further comprising a shoulder belt attached to the first bag.

4. The video camera carrying bag of claim 2, further comprising means for opening and closing the first bag.

5. The video camera carrying bag of claim 2, further comprising means for opening and closing the second bag.

6. The video camera carrying bag of claim 2, further comprising a reinforcing member inserted into said second bag, said reinforcing member being a box having five closed sides and one open side and side corners with cut away portions.

* * * * *